US005207881A

United States Patent [19]

Kaneko et al.

[11] Patent Number: 5,207,881

[45] Date of Patent: May 4, 1993

[54] APPARATUS FOR CONTINUOUS ELECTROLYTIC TREATMENT OF ALUMINUM ARTICLE

[75] Inventors: Nobuyoshi Kaneko; Tsutomu Kakei, both of Shizuoka, Japan

[73] Assignee: Fuji Photo Film Co., Ltd., Minami-ashigara, Japan

[21] Appl. No.: 848,526

[22] Filed: Mar. 9, 1992

[30] Foreign Application Priority Data

Mar. 7, 1991 [JP] Japan ..... 3-041929

[51] Int. Cl.[5] ..... C25D 17/00

[52] U.S. Cl. ..... 204/211

[58] Field of Search ..... 204/211

[56] References Cited

U.S. PATENT DOCUMENTS

| | | | |
|---|---|---|---|
| 3,865,700 | 2/1975 | Fromson | 204/28 |
| 3,989,605 | 11/1976 | Yanagida et al. | 204/28 |
| 4,002,549 | 1/1977 | Yanagisda et al. | 204/211 |
| 4,865,699 | 9/1989 | Fromson et al. | 204/28 |

FOREIGN PATENT DOCUMENTS

| | | |
|---|---|---|
| 2229781 | 5/1974 | France . |
| 43-5528 | 2/1968 | Japan . |
| 47-18739 | 9/1972 | Japan . |
| 48-26638 | 4/1973 | Japan . |
| 56-139697 | 10/1981 | Japan . |
| 58-24517 | 5/1983 | Japan . |

*Primary Examiner*—T. M. Tufariello

*Attorney, Agent, or Firm*—Burns, Doane, Swecker & Mathis

[57] ABSTRACT

An apparatus for continuous electrolytic treatment of an article of aluminum web or an aluminum alloy including an electrolytic part, a pre-stage power supply part provided upstream of the electrolytic part, a post-stage power supply provided, downstream of the electrolytic part and a power source, at least one electrode in the pre-stage power supply part and at least one electrode in the post-stage power supply part part being connected with one pole of the power source, and at least one electrode of the electrolytic part being connected with the other pole of the power source. This apparatus can decrease a running cost such as the electric cost and the cooling cost as well as the facilities cost, can conduct a high speed treatment and increase the thickness of a film without fusing an aluminum article, even if the aluminum article has a small sectional area, such as a wire, a foil or a thin web. The electrolytic treatment can stably continue without preparing some means for preventing corrosion, leakage and the like at the time that the line is speeded up and the thickness of the film is increased.

8 Claims, 2 Drawing Sheets

APPARATUS FOR CONTINUOUS ELECTROLYTIC TREATMENT OF ALUMINUM ARTICLE

BACKGROUND OF THE INVENTION

This invention relates to an apparatus for continuous electrolytic treatment of an aluminum article such as a web, wire or foil made of aluminum or an alloy thereof, particularly to an apparatus for electrolytic treatment capable of solving problems occurred during a high speed driving of an electrolytic line and during electrolysis of a thick film.

A continuous electrolytic treatment has been usually utilized in a wide range such as an anodic oxidation, an electrolytic colouring, an electrolytic polishing and an electrolytic etching, used in manufacturing of a support for a printing plate, an alumite wire, an electrolytic capacitor or the like.

A conventional continuous electrolytic treatment for an aluminum product was conducted by the electrolytic treatment disclosed in Japanese Patent KOKAI Nos. 48-26638 and 47-18739 and Japanese Patent KOKOKU No. 58-24517, and the method is usually referred to as the submerged power supply system. An apparatus for the electrolytic treatment according to the submerged power supply system is shown in FIG. 4. This apparatus is in a type of the anodic oxidation using direct current and is composed of three parts, i.e. a power supply part 2 for charging an aluminum article 1 with a negative charge 7 and electrolytic part 3 for the electrolytical treatment of the aluminum article 1 charged with negative charge and an intermediate part 4 for preventing a short in the liquid between the power supply part 2 and the electrolytic part 3. A power supply electrode 5 and an electrolytic electrode 6 are disposed in the electrolyte solution of the power supply part 2 and the electrolytic part 3, and the power supply electrode 5 is connected to the electrolytic electrode 6 through a direct current source 7.

In the apparatus for electrolytic treatment, the electric current from the direct current source 7 flows to the aluminum product 1 through the electrolyte solution from the power supply electrode 5 in the power supply part 2, flows in the direction of the electrolytic part 3 in the aluminum article 1 and flows to the electrolytic electrode 6 through the electrolyte solution from the aluminum product 1 in the electrolytic part 3. Thus, an oxide film by the anodic oxidation is formed on the surface of the aluminum article 1. In the submerged power supply system, since the article to be treated is not contacted with an electrode or the like, the occurrence of spark during supplying electricity, the occurrence of damages and the like are prevented. Therefore, a line of an electrolytic treatment having a high stability can be provided.

However, there were some problems in the above mentioned apparatus for electrolytic treatment. First, the speedup of a line of electrolytic treatment and the increase in a thickness of the oxide film by the anodic oxidation can not be conducted in low cost. That is, at the case that the line of electrolytic treatment is speeded up for improving productivity and in the case that the thickness of the oxide film by the anodic oxidation is increased for improving quality, an amount of supply current is necessarily increased, a voltage drop caused by ohmic loss is increased in the aluminum article, with increasing a supply current. Therefore, an increase in the electrolytic voltage of a source is necessary.

When the electrolytic voltage is increased, since the electric energy is increased, the running cost is increased, and since a capacity of the source is necessarily large, the plant investment is increased. Besides, since an electrolytic voltage is great, Joule heat greatly generates in the aluminum article between the power supply electrode 5 and the electrolytic electrode 6. As a result, a cooling cost for cooling the aluminum article and the electrolyte solution to a prescribed normal temperature increases. As described above, when the line of electrolytic treatment is speeded up in the conventional apparatus, the cost becomes too great.

Second, in the case that the aluminum article has a small sectional area, the speedup of the line for electrolytic treatment is difficult. That is, since the whole current supplied by a power source flows into the aluminum article at the intermediate part between the power supply part and the electrolytic part, when the amount of supplied current is great, the aluminum article having a small sectional area such as a wire, a foil and a thin web heats up greatly and fuses. Therefore, in the case of the aluminum article having a small sectional area, there is a limit in an amount of supplying current. As a result, the speedup of a line for electrolytic treatment and the increase in a thickness of an oxide film by the anodic oxidation are difficult.

Third, countermeasures for preventing corrosion, leakage and the like are necessary. That is, when a process using an organic solvent such as a coating process is necessary as a post-process of the electrolytic treatment, the aluminum article after the electrolytic treatment process is generally grounded through a means such as a grounding roll in order to prevent explosion, flash and the like caused by the elevation of electric potential of the aluminum article in the post-process. However, in this case, though the electric potential of the aluminum article after the electrolytic treatment bath is kept at almost the same electric potential as the electric potential of the earth, the electric potential of the aluminum product prior to the electrolytic treatment bath is kept at a greater electric potential than the electric potential of the electrolytic treatment bath. Electric current flows accordingly formed in the line through the aluminum article, and then comes back to the direct current source through the pre-treatment apparatus and the post-treatment apparatus for the electrolytic treatment apparatus. As a result, a circuit composed of the aluminum article, the pre-treatment apparatus, the post-treatment apparatus and the like occurs. Troubles, such as corrosion of metal members used in a pipe and a pump, spark trouble and leakage, occur in various treatment apparatuses wherein a pre-treatment of the electrolytic treatment apparatus is conducted by such an electric current.

Therefore, a non-corrosive material or an insulating material must be used in order to prevent the occurrence of the troubles, facilities accordingly become complex. As a result, the facilities cost and the maintenance cost increase greatly. Moreover, when the line for electrolytic treatment is speeded up in order to improve productivity, or when the thickness of the oxide film by the anodic oxidation is increased in order to improve a quality, to elevate an amount of the electric current supply is necessary, electric potential accordingly become greater at the aluminum article before the electrolytic treatment bath than the electric potential of the bath, and this point was particularly great problem.

SUMMARY OF THE INVENTION

An object of the invention is to provide an apparatus for electrolytic treatment capable of decreasing a running cost such as the electric cost and the cooling cost as well as the facilities cost.

Another object of the invention is to provide an apparatus for electrolytic treatment capable of conducting a high speed treatment and increasing the thickness of a film without fusing an aluminum article, even if the aluminum article has a small sectional area, such as a wire, a foil or a thin web.

A further object of the invention is to provide an apparatus for electrolytic treatment capable of stably conducting the electrolytic treatment without preparing some means for preventing corrosion, leakage and the like at the time that the line is speeded up and the thickness of the film is increased.

The present invention has been made in order to achieve the above objects, and provides an apparatus for continuous electrolytic treatment of aluminum web or an alloy thereof, which comprises an electrolytic part, a pre-stage power supply part provided upstream of the electrolytic part, a post-stage power supply provided downstream of the electrolytic part and a power source, at least one electrode in the pre-stage power supply part and at least one electrode in the post-stage power supply part being connected with one pole of the power source, and at least one electrode of the electrolytic part being connected with the other pole of the power source.

Figure 1:
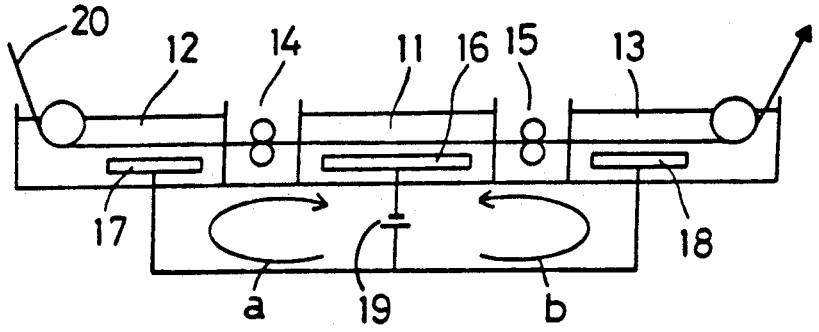
FIG. 1 is a schematic block diagram illustrating an apparatus embodying the invention.

In the figures, the numerals represent parts as follows

11: Electrolytic part
12: Pre-stage power supply part
13: Post-stage power supply part
17, 22, 26: Pre-stage power supply electrode
18, 23, 27: Post-stage power supply electrode
16, 21, 25: Electrolytic electrode
19, 24, 28: Direct current source (power source)

DETAILED DESCRIPTION OF THE INVENTION

In the apparatus of the invention, the pre-stage power supply part and the post-stage power supply part are connected with the same power source, whereby miniaturization of the apparatus, saving of the facilities cost and maintenance cost, stability in manufacturing and the like are improved. The amount of electric current for supplying to the pre-stage power supply part and the post-stage power supply, part may be set arbitrarily. It is preferred however that the entire amount of electric current for supplying to the pre-stage power supply part is the same as the entire amount of electric current for supplying to the post-stage power supply part, in view of achieving the effect of the invention. Besides, a control apparatus controlling the electric current supplied to two power supply parts may be provided.

The power source may be one or plural, and an amount of electric current to be supplied by each power source may be equal, or the current density may be gradually elevated. In the case of two or more power sources, only one of them may be connected with both electrodes of the pre-stage power supply part and the post-stage power supply part, or two or more power sources may be connected with both electrodes.

The wave form of the power source is selected from direct current wave forms, alternating current wave forms, direct-alternating superposition wave forms and the like so as to achieve a desired quality. The electrode may be disposed on one side of the aluminum article only or on both sides, and in the case of the former, the electrode may be disposed at the upper position or lower position. Besides, the location of the pole of the power supply part may be different from the electrode of the electrolytic part.

The electrolyte solution may be an aqueous sulphuric acid solution, aqueous phosphoric acid solution, aqueous oxalic acid solution, an aqueous salt solution thereof and mixture thereof, and a solution suitable for obtaining a desired quality is selected from among them. The temperature and concentration of the electrolyte solution can be arbitrarily selected. The electrolyte solutions of two power supply parts and the electrolytic part may be identical or different.

Moreover, the above apparatus may be used as one unit, and a plurality of the units may be connected in the longitudinal direction. A grounding means, such as a grounding roll, may be provided.

In the apparatus for continuous electrolytic treatment of the invention, there are two routes for supplying electric current to the electrolytic part, i.e. one is the route through the pre-stage power supply part and the other is the route through the post-stage power supply part. Therefore, the amount of the electric current becomes half of the amount of the electric current in one route only, and the electric voltage decreases during the electrolytic treatment. Moreover, since the electric current flows to the electrolytic part through two routes, the length of the aluminum product through which the electric current flow is shortened, and therefore, the electric voltage may be small. Since the electric potential at the aluminum article before the pre-stage power supply part is substantially equal to the electric potential at the aluminum product after the post-stage power supply part, an electric circuit wherein electric current flows in the pre-treatment apparatus and the post-treatment apparatus does not occur, and the occurrence of corrosion of metal members used in a pipe and pump, spark trouble and leakage is prevented.

In FIG. 1, the numeral 11 indicates an electrolytic part, and a pre-stage power supply 12 is disposed upstream and a post-stage power supply 13 is disposed downstream (based on the traveling direction of the aluminum article) of the electrolytic part 11, and a part between the pre-stage power supply 12 and the electrolytic part 11 is a pre-stage intermediate part 14 and a part between the post-stage power supply 13 and the electrolytic part 11 is a post-stage intermediate part 15. The electrolytic part 11, the pre-stage power supply 12 and the post-stage power supply 13 are filled with an electrolyte solution and an electrolytic electrode 16, a pre-stage power supply electrode 17 and a post-stage power supply electrode 18 are respectively disposed in them. The pre-stage power supply electrode 17 and the post-stage power supply electrode 18 are connected with a plus side of a direct current source 19 and the electrolytic electrode 16 is connected with a minus side of the direct current source 19.

The numeral 20 indicates an aluminum article in a web form, and the aluminum article 20 travels sequentially through the electrolyte solution of the pre-stage power the electrolytic part 11, and the post-stage power supply 13.

In a continuous electrolytic treatment using the above apparatus of continuous electrolytic treatment, the aluminum article 1 travels with supplying the direct current source 19. The direct current flows clockwise as shown by an arrow "a" in FIG. 1 on the pre-stage side, and flows counterclockwise as shown by an arrow "b" in FIG. 1 on the post-stage side. The aluminum article accordingly works as an anode in the electrolytic part 11 and an oxide film is formed by the anodic oxidation on the surface thereof.

Figure 2:
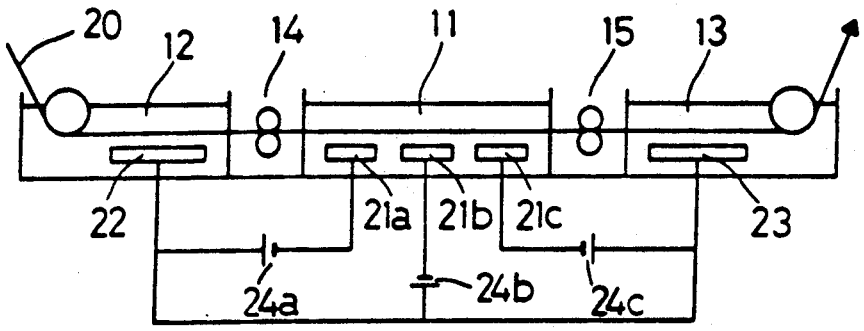
FIG. 2 is a schematic block diagram illustrating another apparatus embodying the invention.

An apparatus for continuous electrolytic treatment shown in FIG. 2 has an electrolytic part 11, a pre-stage power supply 12 and a post-stage power supply part 13 as in the first example, and an aluminum product is disposed as in the first example. Three electrolytic electrodes 21*a*, 21*b*, 21*c* are provided in the electrolytic part 11. A pre-stage power supply electrode 22 is provided in the pre-stage power supply part 12, and a post-stage electrolytic electrode 23 is provided in the post-stage power supply part 13. Three direct current sources 24*a*, 24*b*, 24*c* are further provided. The plus side of the direct current source 24*a* is connected with the pre-stage power supply electrode 22 and the post-stage power supply electrode 23, and the minus side thereof is connected with the electrolytic electrode 21*a*. The plus side of the direct current source 24*b* is connected with the pre-stage power supply electrode 22 and the post-stage power supply electrode 23, and the minus side thereof is connected with the electrolytic electrode 21*b*. The plus side of the direct current source 24*c* is connected with the pre-stage power supply electrode 22 and the post-stage power supply electrode 23, and the minus side thereof is connected with the electrolytic electrode 21*c*.

Figure 3:
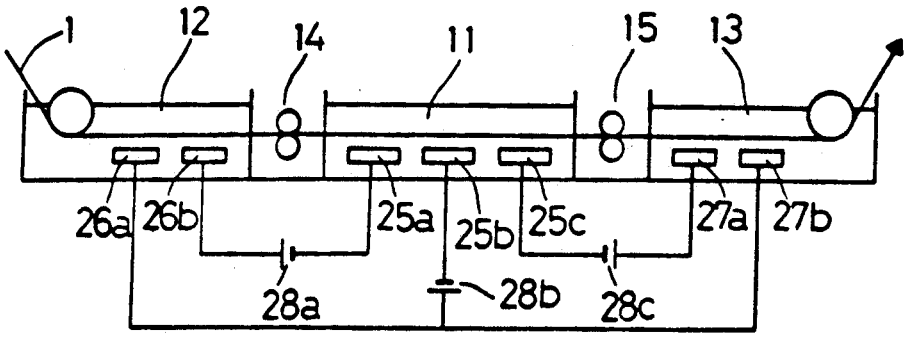
FIG. 3 is a schematic block diagram illustrating still another apparatus embodying the invention.

An apparatus for continuous electrolytic treatment shown in FIG. 3 has an electrolytic part 11, a pre-stage power supply 12 and a post-stage power supply part 13 as in the first example, and an aluminum product is disposed as in the first example. Three electrolytic electrodes 25*a*, 25*b*, 25*c* are provided in the electrolytic part 11. Two pre-stage power supply electrodes 26*a*, 26*b* are provided in the pre-stage power supply part 12, and two post-stage electrolytic electrodes 27*a*, 27*b* are provided in the post-stage power supply part 13. Three direct current sources 28*a*, 28*b*, 28*c* are further provided. The plus side of the direct current source 28*a* is connected with the pre-stage power supply electrode 26*b*, and the minus side thereof is connected with the electrolytic electrode 25*a*. The plus side of the direct current source 28*b* is connected with the pre-stage power supply electrode 26*a* and the post-stage power supply electrode 27*b*, and the minus side thereof is connected with the electrolytic electrode 25*b*. The plus side of the direct current source 28*c* is connected with the pre-stage power supply electrode 27*a*, and the minus side thereof is connected with the electrolytic electrode 25*c*.

EXAMPLE 1

Using the electrolytic apparatus having 12 m in length of the electrolytic part and 5 m in length of the pre and post-stage power supply parts, of which the structure is shown in FIG. 1, the aluminum web article having 0.2 mm in thickness and 1000 mm in width is traveled at 100 m/min. of the traveling speed of the line in the electrolytic apparatus, and the anodic oxidation was conducted at 50 A/dm$^2$ of an electric current density, and as a result, the oxide film having 2 $\mu$m in thickness was formed on the surface of the aluminum article. An aqueous sulfuric acid solution was used in the electrolytic part and the power supply part, as an electrolyte solution. The electrolytic voltage was 50 V and the supply electric power was 2500 kw. The surface temperature of the aluminum article located at the pre-stage and the post-stage intermediate parts was 50° C., and the treatment could be conducted stably for a long time. The difference between an electric potential of the aluminum web in the latter power supply and an electric potential of the aluminum web in the former power supply was not more than 1 V. Moreover, a countermeasure for preventing corrosion and the like was not necessary in the forward and backward position of the treatment apparatus.

COMPARATIVE EXAMPLE 1

Figure 4:
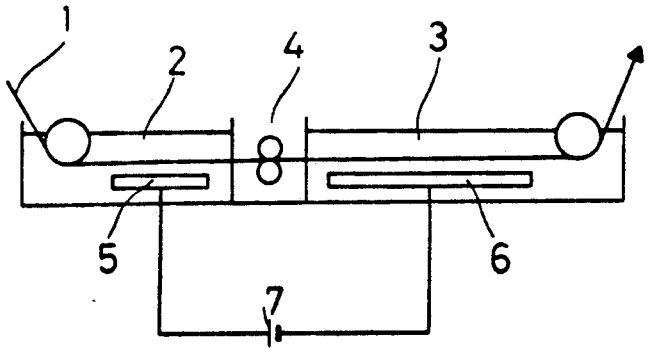
FIG. 4 is a schematic block diagram illustrating conventional apparatus.

Using the electrolytic apparatus having 12 m in length of the electrolytic part and 5 m in length of the power supply, of which the structure is shown in FIG. 4, the aluminum web is treated by an anodic oxidation, and the oxide film having 2 $\mu$m in thickness was formed. The other conditions were the same as in Example 1. The electrolytic voltage was 85 V and the electric power supply was 4500 kw. The difference between an electric potential of the aluminum web after anodizing and before anodizing was about 40 V. Moreover, the surface temperature of the aluminum web located at the intermediate part, and the aluminum web fused down 2 minutes after the start of the treatment.

We claim:

1. An apparatus for continuous electrolytic treatment of an article of aluminum or an alloy thereof wherein the article moves from an upstream end to a downstream end of the apparatus, the apparatus comprising an electrolytic part, a pre-stage power supply part provided upstream of the electrolytic part, a post-stage power supply part provided downstream of the electrolytic part and a direct current power source, at least one electrode in the pre-stage power supply part and at least one electrode in the post-stage power supply part being connected with one pole of the power source, and at least one electrode of the electrolytic part being connected with the other pole of the power source.

2. An apparatus for continuous electrolytic treatment of an article of aluminum or an alloy thereof wherein the article moves from an upstream end to a downstream end of the apparatus, the apparatus comprising an electrolytic part, a pre-stage power supply part provided upstream of the electrolytic part, a post-stage power supply part provided downstream of the electrolytic part and a power source, at least one electrode in the pre-stage power supply part and at least one electrode in the post-stage power supply part being connected with one pole of the power source, and at least one electrode of the electrolytic part being connected with the other pole of the power source, a single electrode being provided in the pre-stage power supply part, a single electrode being provided in the electrolytic part, and a single electrode being provided in the post-stage power supply part.

3. An apparatus for continuous electrolytic treatment of an article of aluminum or an alloy thereof wherein the article moves from an upstream end to a downstream end of the apparatus, the apparatus comprising an electrolytic part, a pre-stage power supply part provided upstream of the electrolytic part, a post-stage power supply part provided downstream of the electrolytic part and a power source, at least one electrode in the pre-stage power supply part and at least one electrode in the post-stage power supply part being connected with one pole of the power source, and at least one electrode of the electrolytic part being connected with the other pole of the power source, a single electrode being provided in the pre-stage power supply part, a single electrode being provided in the post-stage power supply part, and three electrodes being provided in the electrolytic part.

4. An apparatus as described in claim 3, wherein each of the three electrodes is connected to a common power source.

5. An apparatus as described in claim 1, wherein the at least one electrode in the pre-stage power supply part comprises first and second pre-stage electrodes.

6. An apparatus as described in claim 5, wherein the at least one electrode in the post-stage power supply part comprises first and second post-stage electrodes.

7. An apparatus as described in claim 6, wherein the at least one electrode in the electrolytic part comprises first, second and third electrolytic electrodes and the power source comprises first, second and third power sources, one pole of the first power source being connected to the first pre-stage electrode and the other pole of the first power source being connected to the first electrolytic electrode, one pole of the second power source being connected to the first post-stage electrode and the other pole of the second power source being connected to the second electrolytic electrode, and one pole of the third power source being connected to the second pre-stage electrode and the second post-stage electrode and the other pole of the third power source being connected to the third electrolytic electrode.

8. An apparatus as described in claim 1, wherein the power source comprises first, second and third power sources and the at least one electrode of the electrolytic part comprises first, second and third electrolytic electrodes, one pole of the first power source being connected to the electrode in the pre-stage power supply part and the other pole of the first power supply being connected to the first electrolytic electrode, one pole of the second power source being connected to the electrode in the post-stage power supply part and the other pole of the second power source being connected to the second electrolytic electrode, and one pole of the third power source being connected to the electrodes of the pre-stage and post-stage power supply parts and the other pole of the third power source being connected to the third electrolytic electrode.

* * * * *